US007527482B2

(12) United States Patent
Ursan et al.

(10) Patent No.: US 7,527,482 B2
(45) Date of Patent: May 5, 2009

(54) METHOD AND APPARATUS FOR COMPRESSING A GAS TO A HIGH PRESSURE

(75) Inventors: Mihai Ursan, Burnaby (CA); Anker Gram, Vancouver (CA); Gabriel Gavril, Coquiram (CA); Shahin Hessami, North Vancouver (CA); Ian Lockley, Ann Arbor, MI (US)

(73) Assignee: Westport Power Inc., Vancouver, BC (CA)

( * ) Notice: Subject to any disclaimer, the term of this patent is extended or adjusted under 35 U.S.C. 154(b) by 491 days.

(21) Appl. No.: 10/508,617

(22) PCT Filed: Mar. 26, 2003

(86) PCT No.: PCT/CA03/00439

§ 371 (c)(1),
(2), (4) Date: Mar. 10, 2005

(87) PCT Pub. No.: WO03/083298

PCT Pub. Date: Oct. 9, 2003

(65) Prior Publication Data

US 2005/0180864 A1 Aug. 18, 2005

(30) Foreign Application Priority Data

Mar. 28, 2002 (CA) ..... 2379766

(51) Int. Cl.
*F04B 47/08* (2006.01)
*F04B 47/12* (2006.01)

(52) U.S. Cl. ..... 417/375; 417/56; 417/212

(58) Field of Classification Search ..... 417/42, 417/56, 375, 393, 212; 137/527–530
See application file for complete search history.

(56) References Cited

U.S. PATENT DOCUMENTS 3,767,325 A * 10/1973 Schuman ..... 417/207

(Continued)

FOREIGN PATENT DOCUMENTS

DE 164691 10/1995

(Continued)

*Primary Examiner*—Devon C Kramer
*Assistant Examiner*—Patrick Hamo
(74) *Attorney, Agent, or Firm*—McAndrews, Held & Malloy, Ltd.

(57) ABSTRACT

A method is provided for compressing a gas in a single cycle and in a single cylinder to a pressure of at least 17.2 Mpa with a compression ratio of at least about five to one. The method further comprises dissipating heat from the cylinder during the compression stroke whereby the gas is discharged with a temperature significantly less than isentropic. The apparatus comprises a hollow cylinder and a reciprocable free-floating piston disposed therein. The piston divides the cylinder into: (a) a compression chamber within which a gas can be introduced, compressed, and discharged; and, (b) a drive chamber, into which a hydraulic fluid can be introduced and removed for actuating the piston. The apparatus further comprises a piston stroke length to piston diameter ratio of at least seven to one. For operating the apparatus with a compression ratio of at least five to one, an outlet pressure of at least 17.2 Mpa, and a gas discharge temperature significantly less than isentropic, the apparatus can further comprise a variable displacement hydraulic pump for controlling piston velocity, an electronic controller for maintaining an average piston velocity that is less than 0.5 feet per second, and a heat dissipator for dissipating heat from the cylinder.

20 Claims, 6 Drawing Sheets

U.S. PATENT DOCUMENTS 3,986,796 A 10/1976 Moiroux et al.
4,515,516 A 5/1985 Perrine et al.
4,585,039 A 4/1986 Hamilton
4,990,058 A * 2/1991 Eslinger ..... 417/46
5,863,186 A * 1/1999 Green et al. ..... 417/53
6,077,053 A * 6/2000 Fujikawa et al. ..... 417/399
6,375,433 B1 * 4/2002 Du et al. ..... 417/53

FOREIGN PATENT DOCUMENTS

WO WO0034655 6/2000

* cited by examiner

METHOD AND APPARATUS FOR COMPRESSING A GAS TO A HIGH PRESSURE

FIELD OF THE INVENTION

The present invention relates to a method and apparatus for compressing a gas to a high pressure. More particularly, the method comprises compressing a gas in a single cycle and in a single cylinder to a high pressure with a compression ratio of at least about five to one, while dissipating heat from the cylinder during the compression stroke, and discharging the gas with a temperature significantly less than isentropic. The apparatus comprises a free-floating piston disposed within the cylinder and a piston stroke length to piston diameter of at least seven to one.

BACKGROUND OF THE INVENTION

A conventional compressor that is operable to increase the pressure of a gas to a high pressure by a ratio of more than four to one typically employs two stages of compression. Conventional compressors operate under near isentropic conditions and the use of multiple stages allows heat exchangers, also known as intercoolers, to be employed between stages to cool the gas after each stage.

U.S. Pat. No. 5,863,186 (the '186 patent) discloses a method for compressing gases using a multi-stage hydraulically driven compressor. The '186 patent discloses a method and apparatus that does not employ intercoolers, but instead discloses a method of operating multiple cycles of each stage before the target output pressure for that stage is achieved. The '186 patent discloses using a cooling jacket to remove heat from the compressor. The compressor still compresses gas under near isentropic conditions but the use of multiple cycles for each stage allows time for cooling the compressed gas, prior to the operation of the next stage. This arrangement does not allow continuous operation of successive stages because this would not allow sufficient time for cooling the gas between stages. Each stage begins after the previous stage is completed. In the preferred embodiment disclosed by the '186 patent, two stages are employed to raise the pressure of the gas from about 150 to 500 psi (about 1.0 MPa to 3.4 MPa) to a compressor output target pressure between 3000 to 6000 psi (about 20.7 MPa Mpa to 41.4 MPa).

The cost of a multi-stage compressor increases with the number of stages because separate compressor units are required for each stage. Each compression stage requires its own drive, piping and cooling stage, which adds to the manufacturing and maintenance costs associated with such multi-stage systems.

Conventional mechanically driven piston compressors that employ a rotating crankshaft to drive the compressor piston are limited to designs with relatively short piston strokes. Most mechanically driven piston compressors have cylinders with piston stroke length to piston diameter ratios that are less than four to one, and more typically less than two to one. The piston stroke is defined herein as the distance traveled by the piston between the beginning and end of the compression stroke (that is, the maximum linear distance traveled by the piston in one direction). The piston diameter is essentially the same as the cylinder bore diameter. As used herein, the "length to diameter ratio" is defined as the ratio of the piston stroke length to the piston diameter.

Mechanically driven piston compressors typically compensate for their short strokes by operating at high speeds, for example, in hundreds, or more typically, in thousands of cycles per minute.

Known hydraulically driven reciprocating piston compressor systems that employ piston rods to connect the compressor pistons to a drive means, have also employed low length to diameter ratios (typically less than four to one). Low pressure compressors commonly employ a length to diameter ratio of about one to one. As the length to diameter ratio increases, it becomes harder to maintain alignment of the piston rod and piston, which can cause faster wearing around the seals. A higher length to diameter ratio also results in increased piston rod weight because of the increased rod length and the need to design against buckling. A compressor cylinder with a higher length to diameter ratio also requires a more elongated space to accommodate the compressor. That is, such a compressor requires an elongated space to accomodate an elongated cylinder, the piston rod in the extended position, and an elongated hydraulic cylinder. Notwithstanding the problems with alignment and weight, for some applications, such as the aforementioned vehicular fuel compressor application, such an elongated space is not conveniently available.

Free-floating piston compressors have been developed which use the same cylinder for a hydraulic drive chamber and a compression chamber. Free-floating piston compressors have no piston rod and the piston divides the cylinder into the hydraulic drive chamber and the compression chamber. During a compression stroke, hydraulic fluid is directed to the drive chamber to actuate the piston and compress the fluid in the compression chamber. Conversely, during an intake stroke, hydraulic fluid exits from the drive chamber while fluid enters the compression chamber. Some of the spatial limitations that are associated with employing a piston rod and external hydraulic drive can be addressed by employing a free-floating piston, since the length of the apparatus is defined essentially by the length of the compressor cylinder, and the length of the apparatus is not compounded by the length of an extended piston rod and a separate drive cylinder. Accordingly, a compressor that employs a free-floating piston can be at least about half the length of a rod-driven compressor with the same bore and piston stroke.

However, high pressure gas compressors are unknown that can compress a gas by a ratio of five to one or more, in a single cycle of a single stage, and under significantly less than isentropic conditions. As the compression ratio increases the cumulative temperature rise during the compression cycle also increases, and under near isentropic conditions compression is inefficient. For compressors with outlet pressures greater than about 2500 psi (17.2 MPa) and compression ratios greater than about four to one, compressors generally employ at least two stages, and some means for cooling the gas between stages.

An example of an application that requires a gas to be delivered at a high pressure is a fuel compressor system for an internal combustion engine. It is well known for natural gas fuelled engines to mix the gaseous fuel with intake air at relatively low pressures. However, more recent developments have been made to inject gaseous fuel in diesel cycle engines, wherein the gaseous fuel is injected directly into the combustion chamber late in the compression stroke. Compared to the previously described natural gas fuelled engines, these diesel cycle engines require the gaseous fuel to be compressed to a much higher pressure, for example, to overcome the in-cylinder pressure, to satisfy mass flow requirements, and to improve mixing and penetration. By way of example, for such engines, a fuel compressor system receives fuel from a source, such as a storage tank or pipeline, and pressurizes the fuel to a pressure in the range of between about 3000 psi and about 3600 psi (between about 20.7 MPa and about 24.8 MPa), for direct injection into an engine combustion chamber. Depending upon the available pressure from the fuel source, a single stage compressor operable to increase gaseous fuel pressure to injection pressure by a ratio of at least about five to one could replace the final two stages of a conventional multi-stage compressor.

A compressor used for supplying fuel to an engine used as a prime mover for a vehicle or for power generation has different design criteria than a compressor that is used for other applications, such as filling storage vessels. For example, for a vehicular application, a light weight compressor apparatus can reduce vehicle weight and improve overall vehicle efficiency, whereas, reduced weight can not have similar benefits for a compressor installed at a stationary installation. While reliability, durability and efficiency are important for all applications, these characteristics are of particular importance for a compressor used to supply fuel to an engine. A compressor failure can result in costly downtime or stranding a vehicle, while inefficient operation increases operating costs.

In addition, with an engine that is the prime mover for a vehicle, higher fuel consumption reduces vehicle range and limits the routes that a vehicle can be used for. Furthermore, range is also increased by using a fuel compressor with a higher fuel compression ratio because this increases the amount of fuel that can be delivered from the fuel tank.

For engines used for power generation, the efficiency of each component effects overall efficiency, and low efficiency can have significant economic consequences when an engine is run on a continuous basis and under high load conditions.

SUMMARY OF THE INVENTION

There is a need for a method of continuously compressing a gas to a high pressure by a ratio of at least about five to one in a single cycle of a single compressor stage with a discharge gas temperature significantly less than isentropic. The isentropic temperature is defined as the theoretical temperature of a gas after compression when no heat is dissipated. A temperature significantly less than isentropic is defined herein as a gas temperature after compression that is higher than the gas temperature before compression but that is not high enough to inhibit the ability of the compressor to efficiently compress the gas to the desired outlet pressure.

For example, a discharge temperature that is at least 25 degrees Celsius lower than isentropic, and more preferably at least 50 degrees Celsius lower than isentropic, would be considered a discharge temperature that is significantly less than isentropic.

A method is provided of compressing a gas in a hydraulically driven reciprocating piston compressor that comprises a cylinder, a free floating piston disposed within the cylinder between a first closed end and a second closed end, a compression chamber defined by a volume within the cylinder between the first closed end and the piston, and a drive chamber defined by a volume within the cylinder between the second closed end and the piston. The method comprises:

(a) in an intake stroke, supplying the gas to the compression chamber;

removing the hydraulic fluid from the drive chamber, whereby the gas supplied to the compression chamber is at a higher pressure than the hydraulic fluid within the drive chamber causing the piston to move to reduce the volume of the drive chamber and increase the volume of the compression chamber until the compression chamber has expanded to a desired volume and is filled with the gas; and (b) in a compression stroke, supplying the hydraulic fluid to the drive chamber whereby the hydraulic fluid within the drive chamber is at a higher pressure than the gas within the compression chamber, causing the piston to move to increase the volume of the drive chamber and reduce the volume of the compression chamber thereby increasing the pressure of the gas held within the compression chamber;

discharging the gas from the compression chamber when the pressure of the gas is increased in a single cycle to a pressure of at least 2500 psi (about 17.2 MPa), which is at least about five times greater than the pressure of the gas supplied to the compression chamber; and dissipating heat from the cylinder during the compression stroke whereby the gas is discharged from the compression chamber with a temperature significantly less than isentropic.

In a preferred method a piston stroke length to piston diameter ratio of more than seven to one is employed. Using a higher length to diameter ratio provides more surface area for heat dissipation and shorter heat conduction paths within the cylinder chambers to the cylinder walls. For example, cylinders with a piston stroke length to piston diameter ratio of between ten to one and one hundred to one are possible. What is surprising with the preferred method is the amount of heat that can be dissipated during a compression stroke. Dissipating a significant amount of heat from the compressor cylinder allows gas to be compressed to higher pressures and with higher compression ratios, compared to conventional compressors. As previously noted, for high pressure gas compression, compared to the present method, conventional methods employ a plurality of compression stages with lower compression ratios and means for dissipating heat external to the compressor cylinder, for example, with intercoolers, aftercoolers, and hydraulic fluid coolers.

A compressor cycle is defined by the completion of an intake stroke and a compression stroke. The speed of the compressor measured in cycles per minute also influences the ability of the apparatus to dissipate heat from the compression cylinder. Whereas the speed of conventional compressors has been generally governed by mass flow requirements (that is the output capacity of the compressor), the present method operating the compressor at a speed that enhances heat dissipation. In the compressor speed ranges within which conventional compressors operate, the speed does not have a significant effect on heat dissipation. According to the present method, compared to conventional compressors, when piston velocity and/or compressor speed (measured in cycles per minute) is reduced by about an order or magnitude, changes in piston velocity and compressor speed begin to have a significant effect on heat dissipation. According to the present method, compressor speed is preferably no greater than 20 cycles per minute. For compressors with higher length to diameter ratios, a compressor speed less than 20 cycles per minute can result in a piston velocity of several feet per second, but as disclosed herein, the higher length to diameter ratio and low number of cycles per minute provide heat dissipation advantages that offset the disadvantages associated with a higher average piston velocity. Compressors with lower length to diameter ratios preferably have an average piston velocity less than 1.5 feet per second (about 0.46 meters per second). For example, a compressor with a length to diameter ratio of about seven and a half to one preferably has an average piston velocity less than 0.5 feet per second (about 0.15 meter per second).

Operating at low speeds can also provide advantages resulting from less component wear and increased durability. Heat dissipation from the cylinder helps to keep piston ring seals at lower temperatures, which can be beneficial to reducing wear and degradation of materials.

Preferred embodiment of the method further comprises transferring heat from the cylinder to the ambient environment through a heat dissipator. An example of a heat dissipator is a cooling jacket disposed around the cylinder, wherein the method further comprises directing a coolant to flow through the cooling jacket. Heat dissipation is improved by maintaining a coolant flow velocity through the cooling jacket that ensures there are no stagnant pockets within the cooling jacket. Higher velocities can also promote turbulence that enhances heat transfer to the coolant from the cylinder wall. When the compressor is part of a system that includes an engine, the coolant can be conveniently supplied from the coolant reservoir of an engine coolant subsystem. However, the coolant that circulates to an engine is generally too hot to have a substantial effect as a coolant supplied to the compressor cylinder, and so when engine coolant is employed it preferably is supplied from a circuit that is independent from engine cooling circuits.

Instead of using a cooling jacket and a liquid coolant, the heat dissipator can comprise a plurality of thermally conductive fins protruding from the cylinder. Such a heat dissipator operates by conducting heat from the cylinder to the plurality of fins, which provide a greater surface area for transferring heat to the ambient environment. When this type of heat dissipator is employed the method can further comprise blowing air through the plurality of fins to enhance heat dissipation.

The method of dissipating more heat from the compressor cylinder can be combined with controlling piston velocity during the compression stroke. In one embodiment of the method, the piston preferably travels with at a first velocity during a first portion of the compression stroke and with a second velocity during a second portion of the compression stroke. The second portion follows sequentially after the first portion and the second velocity is lower than the first velocity. Controlling piston velocity in this manner allows the piston to travel at a higher velocity during the early part of the compression stroke when there is less cumulative temperature rise, and at a slower velocity later in the compression stroke when there is more cumulative temperature rise. The timing for changing from the first portion of the compression stroke to the second portion of the compression stroke can be handled in a number of ways. For example, this change can occur when an electronic controller determines that a predetermined criteria is satisfied such as, for example, when gas pressure within the compression chamber or gas discharge temperature exceeds a predetermined set point, or when the piston is at a predetermined location within the cylinder.

Reducing piston velocity also helps to reduce component wear and methods for improving heat dissipation also reduce the operating temperature of components and seals, which can prolong their life (if such components degrade over time with exposure to heat and/or thermal cycling).

The method can further comprise controlling piston velocity during a discharge portion of the compression stroke that occurs after the second portion of the compression stroke. During the discharge portion of the compression stroke, the gas pressure within the compression chamber is greater than the gas pressure downstream from the compressor cylinder and gas is being discharged from the compression chamber. During the discharge portion of the compression stroke, piston velocity is preferably kept substantially constant. Piston velocity during the discharge portion of the piston stroke is preferably equal to or less than piston velocity at the end of the second portion of the compression stroke. Piston velocity can be controlled to follow a predetermined speed profile during the compression stroke. According to one method, a speed profile can be selected from a plurality of predetermined speed profiles to control piston velocity at different times during a compression stroke. Preferably the speed profile controls piston velocity to be highest near the beginning of the compression stroke with piston velocity gradually declining to a lower velocity before stopping at the end of the compression stroke. The differences between the plurality of predetermined speed profiles can be piston velocity at different times and/or the rate that piston velocity changes during the compression stroke. Of the plurality of predetermined speed profiles, the speed profile can be selected to maximize thermodynamic efficiency of compression for the desired mass flow rate and compression ratio.

When gas is being discharged from the compressor, piston velocity can be controlled to be substantially constant until near the end of the piston stroke when piston velocity can be further reduced until the piston eventually stops at the end of the compression stroke. According to this method, the power supplied to the hydraulic pump can fluctuate during compressor operation, depending upon how piston velocity is controlled. An objective of this method is controlling piston velocity to achieve a desired amount of heat dissipation.

The piston speed profile can be selected in response to a measured operating parameter. For example, the selected speed profile can be responsive to desired mass flow rate, inlet gas pressure, desired gas pressure, and desired compression ratio.

A controller that operates the compressor can select a predetermined speed profile from a plurality of predetermined speed profiles. Of the available speed profiles, the selected speed profile preferably maximizes thermodynamic efficiency of compression for the desired mass flow rate and compression ratio.

In systems that operate for long periods of time in a steady state condition, it is preferable for the power demands of system components to be substantially constant. Accordingly, with such systems, rather than controlling piston velocity, a preferred method further comprises supplying a substantially constant amount of power to a hydraulic pump during a compression stroke. This can be achieved with a constant power hydraulic pump. A consequence of operating in this manner is that piston velocity automatically decreases as gas pressure within the compression chamber increases, which is beneficial for heat dissipation.

The present disclosure describes an apparatus for compressing a gas to a high pressure. The apparatus comprises a reciprocating piston compressor that has a piston stroke length to piston diameter ratio of at least seven to one. The apparatus is operable to compress a gas in a single cycle of a single stage from a pressure of between about 300 to about 600 psi (about 2.1 to about 4.1 MPa) to a pressure of between 2500 to 5000 psi (about 17.2 to about 34.5 MPa) with a discharge gas temperature significantly less than isentropic. Conventional compressors that are operable to compress a gas to such high pressures typically do not have compression ratios greater than about four to one. Compression ratios higher than five to one are preferred because this allows a gas to be compressed to a high pressure using less stages. By way of example, with the disclosed apparatus compression ratios between eight to one and ten to one can be achieved. A number of features can be combined with the apparatus to facilitate its operation or to reduce discharge gas temperature further.

In particular, an apparatus for compressing a gas to a high pressure comprises:

(a) a hollow cylinder;

(b) a free-floating piston reciprocable within the cylinder, the piston dividing the cylinder into, a compression chamber within which a gas can be introduced, compressed, and discharged; and a drive chamber, into which a hydraulic fluid can be introduced and removed for actuating the piston; and (c) a piston stoke length to piston diameter of at least seven to one;

whereby the piston is operable to compress a gas by a ratio of at least five to one in a single cycle to an outlet pressure of at least 2500 psi (about 17.2 Mpa) with a discharge gas temperature significantly less than isentropic.

The apparatus can further comprise a controller for maintaing an average piston velocity during a compression stroke that is less than 1.5 feet per second (0.46 meter per second). In some embodiments an average piston velocity of less than 0.5 feet per second (about 0.15 meter per second) is preferred.

A variable displacement hydraulic pump can be employed for supplying hydraulic fluid to the drive chamber. By changing hydraulic fluid flow rate piston velocity can be changed during a compression stroke. The apparatus preferably further comprises a controller for controlling hydraulic pump displacement while operating the apparatus during a compression stroke. Accordingly in preferred embodiments, such a controller is operable to control the hydraulic pump displacement to increase, decrease or maintain the flowrate of hydraulic fluid into the drive chamber, whereby piston velocity changes to predetermined speeds at predetermined times during a compression stroke. By way of example, the controller can be an electronic controller or a pre-calibrated mechanical controller. For example, in one embodiment, an electronic controller can be operable to control the hydraulic pump displacement with response to measured parameters comprising at least one of gas discharge temperature, gas pressure within the compression chamber, and piston position within the compression cylinder.

Instead of a variable displacement hydraulic pump, a variable speed hydraulic pump can be employed, whereby piston velocity is controllable to increase or decrease piston velocity during a compression stroke. For example, piston velocity can be reduced by reducing the speed of the variable speed hydraulic pump when gas pressure within the compression chamber exceeds a predetermined set point.

In the alternative, as already disclosed with reference to the method, the apparatus can further comprise a constant power hydraulic pump for supplying hydraulic fluid to the drive chamber.

A feature of the present invention is that it employs length to diameter ratios that are higher than those typically employed by conventional gas compressors. Another advantage of a higher length to diameter ratio is that it can facilitate reducing the proportion of dead space volume to total cylinder volume, which helps to improve compressor efficiency. Preferably the dead space volume is less than 0.3% of total compression chamber volume.

A higher length to diameter ratio also allows longer piston strokes and potentially less cycles per minute for improved efficiency. A lower compressor speed can be compensated for by a larger compression chamber volume, provided by an elongated cylinder. At lower compressor speeds, there are additional efficiency gains because there is less switching in the hydraulic system, and with less cycles the dead space at the end of the piston compression stroke is not encountered as often.

An additional feature that can be combined with the apparatus is a heat dissipator for dissipating heat from the cylinder. The heat dissipator substantially surrounds the cylinder for receiving and dissipating heat from the cylinder. In a preferred embodiment, the heat dissipator comprises a cooling jacket through which a coolant fluid can be directed to receive and remove heat therefrom. The cooling jacket preferably comprises a shell structure spaced apart from the cylinder, and a coolant inlet associated with one end of the cylinder and a coolant outlet associated with an opposite end of the cylinder, whereby coolant can enter the cooling jacket through the coolant inlet and flow between the shell and the cylinder to the coolant outlet.

In another preferred embodiment the heat dissipator comprises a plurality of fins protruding from the cylinder to conduct heat from the cylinder to the ambient environment. A fan can be added for directing air to flow between the plurality of fins to further increase heat dissipation.

The apparatus preferably comprises two cylinders that are operable in tandem to supply a more continuous flow of high-pressure gas.

In a preferred embodiment of an apparatus comprising two cylinders, the apparatus comprises:

(a) a first reciprocating compressor comprising a first hollow cylindrical body with fluidly sealed ends, a first free-floating piston disposed within the first hollow cylindrical body defining a first drive chamber having a hydraulic fluid port and a first compression chamber having a gas port selectively connectable to a low pressure gas supply system or a high pressure gas system;

(b) a second reciprocating compressor comprising a second hollow cylindrical body with fluidly sealed ends, a second free-floating piston disposed within the second hollow cylindrical body defining a second drive chamber and a second compression chamber having a hydraulic fluid port and a first compression chamber having a gas port selectively connectable to the low pressure gas supply system or the high pressure gas system;

(c) a hydraulic drive system that is operable to alternate between:

supplying hydraulic fluid to the first drive chamber while withdrawing hydraulic fluid from the second drive chamber; and withdrawing hydraulic fluid from the first drive chamber while supplying hydraulic fluid to the second drive chamber;

whereby the first and second reciprocating compressors are operable in tandem to increase the pressure of the gas by a ratio of at least about five to one to a pressure of at least about 2500 psi (about 17.2 MPa) with a discharge gas temperature significantly less than isentropic.

The first and second reciprocating compressors preferably have substantially the same dimensions.

The hydraulic drive system can comprise a reversible hydraulic pump for reversing the direction of hydraulic fluid flow. In an alternative arrangement, the hydraulic drive system comprises a flow-switching valve operable to selectively direct the hydraulic fluid to one of the first and second drive chambers through the hydraulic fluid ports to cause a compression stroke while simultaneously receiving hydraulic fluid from the other one of the first and second drive chambers to cause an intake stroke.

As disclosed, the apparatus can be combined with one or more of the disclosed features to reduce gas temperature and improve thermodynamic efficiency.

BRIEF DESCRIPTION OF THE DRAWINGS

The drawings illustrate specific embodiments of the invention but should not be considered as restricting the spirit or scope of the invention in any way.

DETAILED DESCRIPTION OF PREFERRED EMBODIMENT(S)

Figure 1:
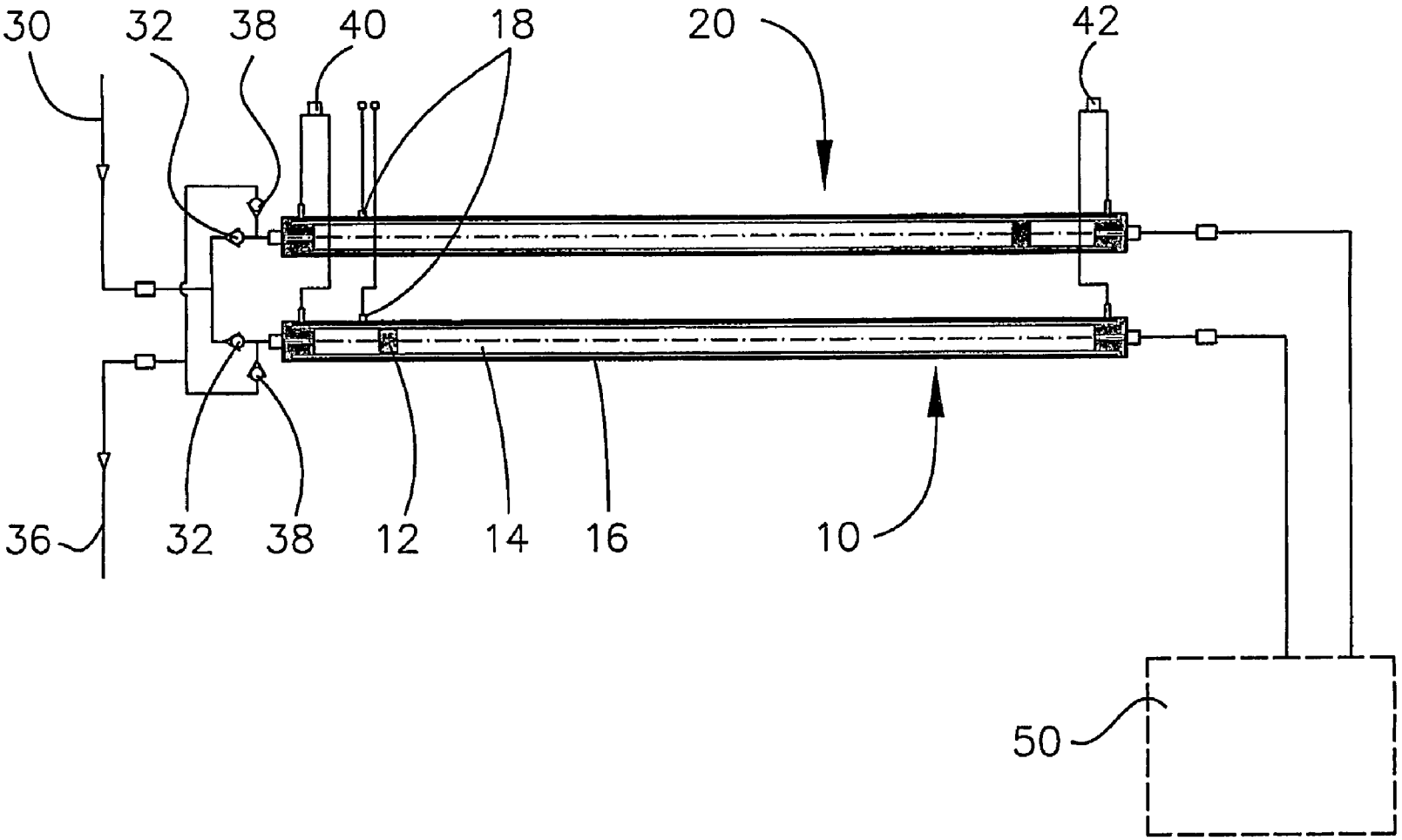
FIG. 1 is a schematic diagram of an apparatus for compressing gas comprising two hydraulically driven reciprocating compressors operating in tandem.

Referring to the drawings, FIG. 1 is a schematic diagram of a preferred apparatus for compressing gas comprising two hydraulically driven reciprocating compressors 10 and 20. Compressors 10 and 20 operate in tandem, with each compressor capable of increasing the pressure of a fluid in a single cycle of each stage by a ratio of at least about five to one. For example, a gas can be compressed in such an apparatus from an inlet pressure of 500 or 600 psi (about 3.4 or about 4.1 MPa) to an outlet pressure of at least 2500 to 3000 psi (about 17.2 to about 20.7 MPa). Higher compression ratios are preferable because they allow the number of compression stages to be reduced. For example, compression ratios of between eight to one and ten to one are possible with embodiments of the disclosed apparatus to achieve outlet pressures of between 2500 psi (about 17.2 Mpa) and 5000 psi (about 34.5 Mpa).

The embodiments of compressors described herein generally have length to diameter ratios of at least seven to one, but an equally important feature of these embodiments is that they are operable continuously with a discharge gas temperature significantly less than isentropic. By way of example, the compressors schematically shown in FIG. 1 have a length to diameter ratio of about fifteen to one.

In the embodiment of FIG. 1, compressor 10 is made to the same specifications as compressor 20, and they are substantially identical. In a compressor cycle of 360 degrees, the initiation of a compression stroke in one of the compressors is offset from the initiation of a compression stroke in the other compressor by about 180 degrees. That is, the initiation of each piston stroke is roughly synchronized so that when one compressor is beginning its compression stroke, the other compressor is beginning its intake stroke. In practice, the piston completing an intake stroke typically reaches the end of its stroke shortly before the other piston completes its compression stroke.

Free-floating piston 12 is movable within compressor cylinder 14 under the influence of a pressure differential on opposite sides of piston 12. On one side of piston 12, cylinder 14 is filled with hydraulic fluid in a drive chamber and on the other side of piston 12, cylinder 14 is filled with gas in a compression chamber. Cooling jacket 16 is spaced from cylinder 14, forming an annular cavity through which coolant can flow around cylinder 14 to dissipate heat therefrom. Sensor 18 is employed to detect the position of piston 12.

Inlet pipe 30 is fluidly connected to compressor inlet ports for directing gas into the compressor compression chambers during respective intake strokes. One-way flow controllers 32 allow gas to enter the respective compression chambers from inlet pipe 30, and prevent compressed gas from flowing back into inlet pipe 30. The term "one-way flow controller" when used herein will be understood by those skilled in the art to be known types of flow controlling devices, generally known as check valves, which permit fluid flow in one direction while preventing flow in the reverse direction, such as, for example, ball check valves, spring assisted ball check valves, wafer check valves, disc check valves, and compressor valves.

Discharge pipe 36 fluidly connects outlet ports from the compressor compression chamber to a high-pressure system, such as, for example, a fuel supply system for an engine. Such a fuel supply system can include an accumulator vessel that is filled with high-pressure gas to ensure a sufficient supply is available. One-way flow controllers 38 allow compressed gas to exit from the compressor chambers and flow to discharge pipe 36, while preventing gas delivered to discharge pipe from returning to the compressor chambers.

Coolant supply pipe 40 connects the cavity between cooling jacket 16 and cylinder 14 with a supply of coolant. Heat is transferable from cylinder 14 to the coolant and warmed coolant is removed from the cavity through an outlet connected to coolant return pipe 42, which returns the coolant to the cooling system. For example, when the compressor is used to supply a high-pressure fuel to an engine, the cooling system employed to supply coolant to the engine can also be employed to supply coolant to the cooling jacket for the compressors. However, a separate cooling loop can be employed if the engine coolant flowing in the engine coolant loop is not significantly cooler than the compressed gas. For example, an engine can have a separate cooling loop for turbocharger intercoolers, and the coolant flowing through such a loop can be significantly cooler than the coolant that is used to cool the engine. An independent cooling loop is employed if the engine coolant is too hot. A higher temperature differential between the coolant and the warmer compressed gas is preferred, and in general, coolant is preferably supplied with a temperature less than 50 degrees Celsius.

The flow rate of the coolant is high enough to prevent local boiling of the coolant and to prevent stagnant pockets from forming within the cooling jacket cavity. Higher velocity flow also results in less temperature gain in the coolant, more turbulence in the boundary layer next to the cylinder wall, and higher heat transfer rates. Turbulence increases thermal conductivity from the cylinder to the coolant.

Hydraulic drive systems are well known but a preferred arrangement for the compressor apparatus is a closed loop system. A closed loop design helps to synchronize the movements of the pistons in the two compressors and is also more efficient since the hydraulic fluid is delivered to the pump at high pressure from a drive chamber instead of at atmospheric pressure from a reservoir (as in the case of an open loop system).

Compressor operation is substantially the same for all embodiments. During the compression stroke, hydraulic fluid is directed to the drive chamber while a gas is compressed in the compression chamber. As hydraulic fluid is introduced into the drive chamber, free-floating piston 12 advances within cylinder 14 to expand the volume of the drive chamber and reduce the volume of compression chamber.

In a preferred embodiment, the hydraulic pump is a horsepower limited pump so the power required by the pump is substantially constant during operation and the velocity of piston 12 automatically changes during the compression stroke so that it is fastest at the beginning of the compression stroke and progressively slower until discharge pressure is reached. A lower piston velocity in the later part of the compression stroke is advantageous for heat dissipation and achieving a discharge gas temperature significantly less than isentropic for efficient compression of the gas. Generally, relatively little heat is generated in the compression gas while the compression ratio remains below about three to one, so during the early part of the compression stroke the piston velocity can be higher since there is less need to provide time for heat dissipation. Later in the compression stroke, when more heat is generated, a lower piston velocity allows more time for heat dissipation. This method of operation is discussed in greater detail below, with reference to FIG. 5.

In another preferred embodiment the hydraulic system employs a variable displacement hydraulic pump that can be controlled to change piston velocity for better heat dissipation. This method is also discussed in greater detail below.

Position sensor 18 is used to determine when piston 12 is near the end of the compression stroke to signal when hydraulic fluid flow should be reversed. Position sensor 18 is preferably a sensor that can be mounted on the outside of the compressor body, for ease of maintenance and so that the only ports required in the cylinder head are for fluid entry and exit. Many types of suitable sensors are known to persons skilled in the art. For example, a magnetic switch can be employed to detect the position of piston 12 near the end of the compression stroke.

Compressed gas exits cylinder 14 to discharge pipe 36 when the pressure within the compression chamber is greater than the pressure within discharge pipe 36. In preferred embodiments, when the compressor is operating at its maximum compression ratio, exit pressure of the compressed gas is at least five times greater than the inlet pressure, and in some embodiments exit gas pressure can be between about seven and ten times greater than the inlet pressure. One-way flow controllers such as check valves 38, prevent pressurized gas from flowing back into the compression chamber from discharge 36.

When the piston reaches the end of the compression stroke, the volume of the compression chamber at that point defines a "dead space". The gas retained in the dead space is compressed to a high pressure but is not expelled in the compression stroke.

Reciprocating piston compressors normally have a dead space, however, the larger the ratio of dead space to compression chamber volume, the lower the efficiency of the compressor. When the piston reverses direction, the retained pressurized gas expands and fills the growing volume of the compression chamber. For the initial portion of the intake stroke, the retained gas causes the pressure within the compression cylinder to remain greater than the pressure in inlet pipe 30, preventing new gas from entering. A smaller dead space means more new gas can be drawn in from inlet pipe 30 during each intake stroke, resulting in higher compressor efficiency.

Compressors can be designed to reduce dead space by reducing the amount of cylinder length that corresponds to the dead space. If compressor cylinders of different lengths all have a dead space defined by a cylinder length of between about ¼ inch and 18 inch (about 6 to 3 mm), an advantage of a compressor with a higher length to diameter ratio is that the cylinder length associated with the dead space represents a smaller fraction of compression chamber volumetric capacity. By way of example, if Compressor A has a cylinder length of 60 inches (1524 mm), and Compressor B has a cylinder length of 4 inches (102 mm), and both compressors have a dead space cylinder length of ⅛ inch (3 mm), in Compressor A, the dead space represents 0.2% of the cylinder volume, whereas in Compressor B, the dead space represents 3.1% of the cylinder volume. Accordingly, compressors with higher length to diameter ratios can be more efficient because the dead space represents a smaller fraction of the compression chamber volumetric capacity for a given cylinder length of dead space. With the compressor configurations disclosed herein, a dead space volume that is less than or equal to 0.3% of the cylinder volume is preferred. For example, a cylinder with a length of 80 inches (about 2032 mm) and a dead space cylinder length of ⅛ inch (about 3.2 mm) has a dead space volume that is 0.16% of the cylinder volume.

At the end of the compression stroke, piston 12 reverses direction. To trigger the beginning of the intake stroke, the flow of hydraulic fluid is reversed, for example, by reversing the hydraulic fluid flow through a reversible pump, or by operating a flow switching device that redirects the flow of hydraulic fluid between hydraulic fluid passages so that the drive chamber that was connected to the hydraulic pump discharge during the compression stroke is now connected to the suction of the hydraulic pump (in a closed loop system) or to a drain passage (in an open loop system). By design, during the intake stroke the pressure of the gas in inlet pipe 30 and the pressure of the gas within the dead space of the compression chamber is greater than the pressure of the hydraulic fluid in the drive chamber. As a result, piston 12 moves under the influence of the gas pressure within the compression chamber and piston 12 pushes the hydraulic fluid out of the drive chamber and into the suction of the hydraulic pump.

At the end of the intake stroke the compression chamber of cylinder 14 is filled with gas from inlet pipe 30, and this gas is ready for compression in the next compression stroke.

While the operation of compressor 10 alone has been described above, in the preferred embodiment shown in FIG. 1, compressors 10 and 20 operate in tandem with their cycles offset by 180 degrees, so that when compressor 10 is beginning its compression stroke, compressor 20 is beginning its intake stroke, and vice versa. Pairing two compressors in this manner allows a more continuous stream of compressed gas to be supplied to discharge pipe 36, in addition to providing a convenient arrangement for a closed loop hydraulic drive system.

Figure 2:
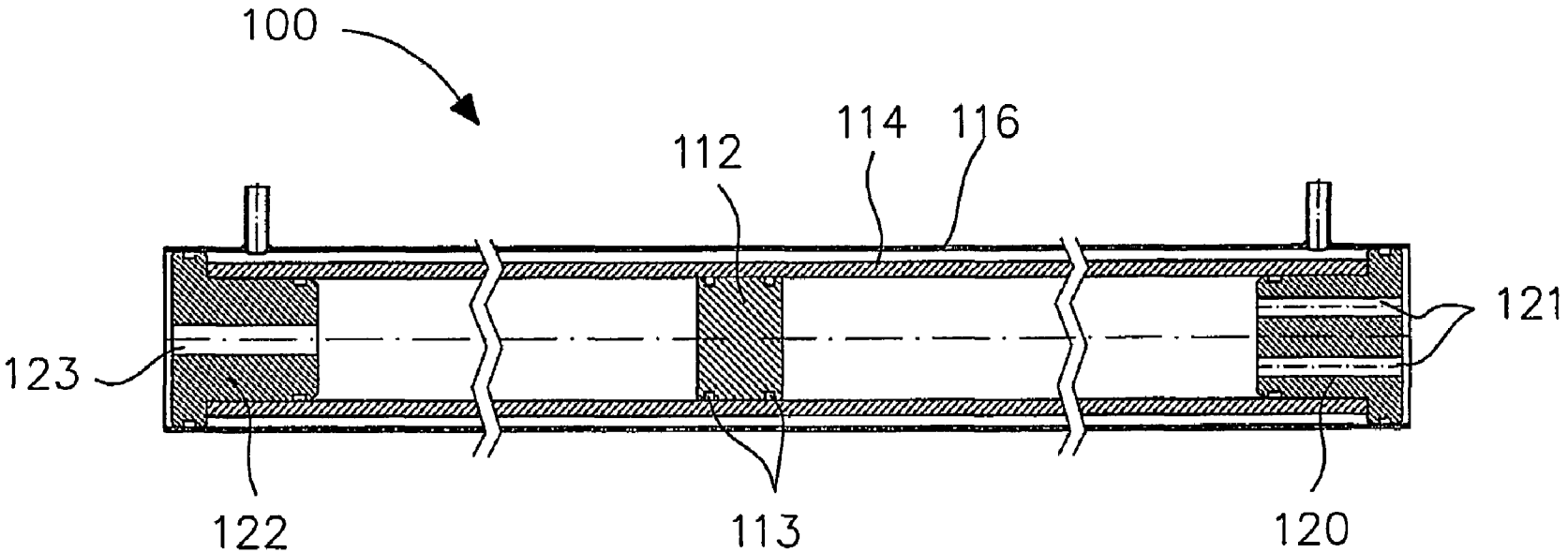
FIG. 2 is a section view of a reciprocating compressor which illustrates a free-floating piston disposed in the compressor cylinder, with a cooling jacket disposed around the compressor cylinder.

FIG. 2 shows compressor 100, which illustrates a preferred embodiment of a compressor with a length to diameter ratio of about eight to one. Compressor 100 comprises free-floating piston 112 disposed within cylinder 114, defining a compression chamber between piston 112 and end plate 120 and a drive chamber between piston 112 and end plate 122. End plate 120 comprises bores 121 for respective inlet and outlet passages from the compression chamber. One-way flow controllers can be installed within end plate 120 to control the direction of flow through passages 121. End plate 122 comprises bore 123 through which hydraulic fluid flows into and out of the drive chamber. An advantage of the present compressor is its simplicity compared to conventional multi-stage compressors. Hollow cylinders are easy to manufacture and are readily available for purchase in specified lengths.

Free-floating piston 112 moves within cylinder 114 under the influence of a pressure differential between the drive and compression chambers, as described with reference to FIG. 1. Ring seals 113 provide sealing between piston 112 and the interior surface of cylinder 114.

Free-floating piston 112 preferably reciprocates with an average cycle frequency less than 20 cycles per minute. Higher cycle frequencies allow less time for cooling during compression. As disclosed above, piston velocity preferably changes during the compression stroke to enhance heat dissipation. Compressor cycle frequency for a given flow capacity varies according to the length to diameter ratio and the length of the piston stroke. As will be discussed again with respect to the examples set out below, in the course of a compression stroke a lower average piston velocity also allows more time for heat to be dissipated. However, as the length to diameter ratio increases, the compressor is better able to dissipate heat, and higher piston velocities can be tolerated.

Cooling jacket 116 is spaced from and surrounds cylinder 114, providing an annular cavity through which a coolant can flow.

Figure 3:
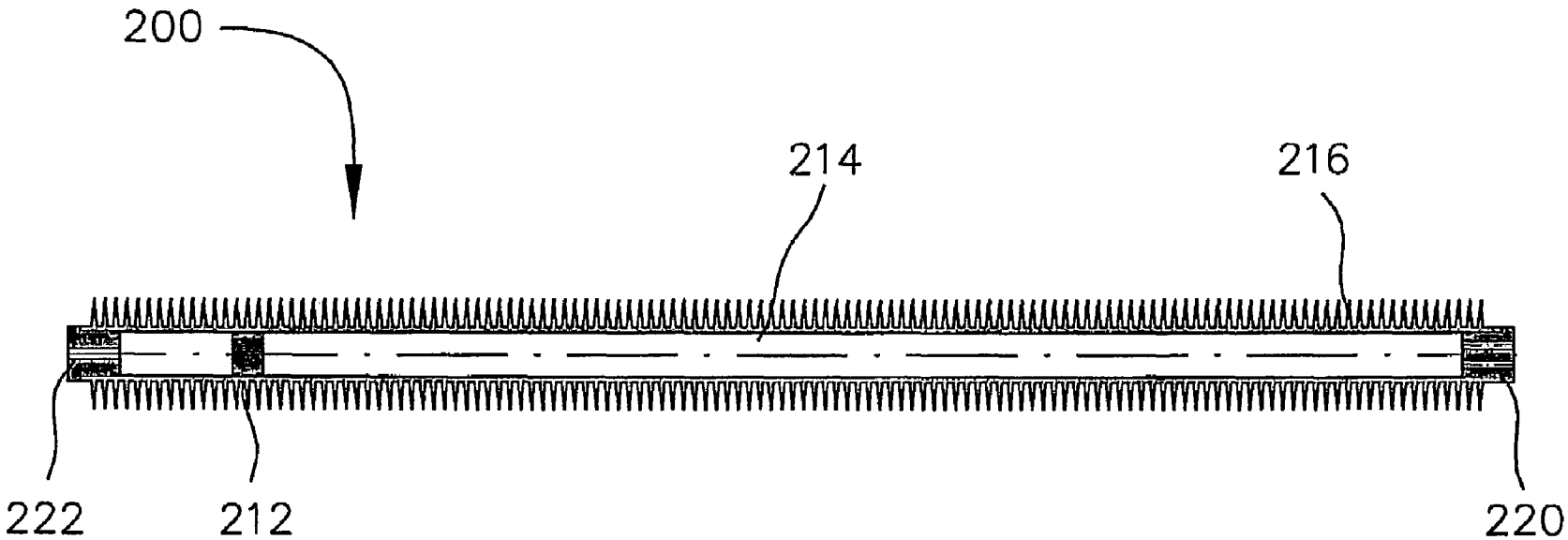
FIG. 3 is a section view of a reciprocating compressor which illustrates a free-floating piston disposed in the compressor cylinder with cooling fins extending radially from the compressor cylinder.

FIG. 3 shows compressor 200, which illustrates a preferred embodiment of a compressor with a length to diameter ratio of about thirty to one. By way of example, for a flow capacity of about 30 standard cubic feet per minute (about 0.8 standard cubic meters per minute), a compressor cylinder with a diameter of 1 inch (about 25.4 cm) and a length of about 30 inches (762 cm) can be employed to raise the pressure of a gas from an inlet pressure of about 600 psi (about 4.1 MPa) to an outlet pressure of at least about 3000 psi (about 20.7 MPa).

Compressor 200 comprises free-floating piston 212 disposed within cylinder 214. Piston 212 defines a compression chamber between piston 212 and end plate 220 and a drive chamber between piston 212 and end plate 222. Free-floating piston 212 moves within cylinder 214 under the influence of a pressure differential between the drive and compression chambers, as described with reference to FIG. 1.

The heat dissipator in the embodiment of FIG. 3 comprises heat conductive fins 216 that radiate from cylinder 214. Heat is conducted away from cylinder 214 and transferred from fins 216 to the cooler ambient air. For applications that require enhanced cooling, air flow through fins 216 can be increased, for example, by using a fan (not shown) or by positioning cylinder 214 in a location where there is a cool air flow.

Heat dissipation can be improved by employing smaller cylinder diameters, which result in a shorter heat conduction path between the center of the cylinders and the cylinder walls. Higher length to diameter ratios also yield larger cylinder wall areas which results in a larger surface area for heat transfer. In compressor cylinders with higher length to diameter ratios, these features combine to assist with heat dissipation, making compression with a discharge gas temperature significantly less than isentropic possible. The following table illustrates the effect of increasing the length to diameter ratio on cylinder wall area for a constant compression chamber volume.

TABLE 1

| Length to Diameter Ratio | Relative Cylinder Wall Area |
|---|---|
| 1:1 | 1.00 |
| 4:1 | 1.59 |
| 8:1 | 2.00 |
| 9:1 | 2.08 |
| 10:1 | 2.15 |
| 15:1 | 2.47 |
| 30:1 | 3.11 |
| 50:1 | 3.68 |
| 100:1 | 4.64 |

As illustrated by Table 1, a length to diameter ratio equal to or greater than eight to one results in at least twice as much surface area, compared to a cylinder with a piston stoke length to diameter ratio of one to one. Since the amount of surface area continues to increase as the length to diameter ratio increases, for improved heat dissipation, higher length to diameter ratios are preferred over lower length to diameter ratios.

Reciprocating piston compressors with very high length to diameter ratios can be achieved by employing cylinders with smaller bore diameters. For example, length to diameter ratios of between 50:1 and 100:1 can be easily achieved with a bore diameter of ½ inch (about 13 mm), and a length of between 25 inches (about 635 mm) for a 50:1 ratio, and 50 inches (about 1270 mm) for a 100:1 ratio. Such a small bore diameter results in a relatively small cylinder volume so a plurality of small bore cylinders can be combined to increase flow capacity.

Figure 4:
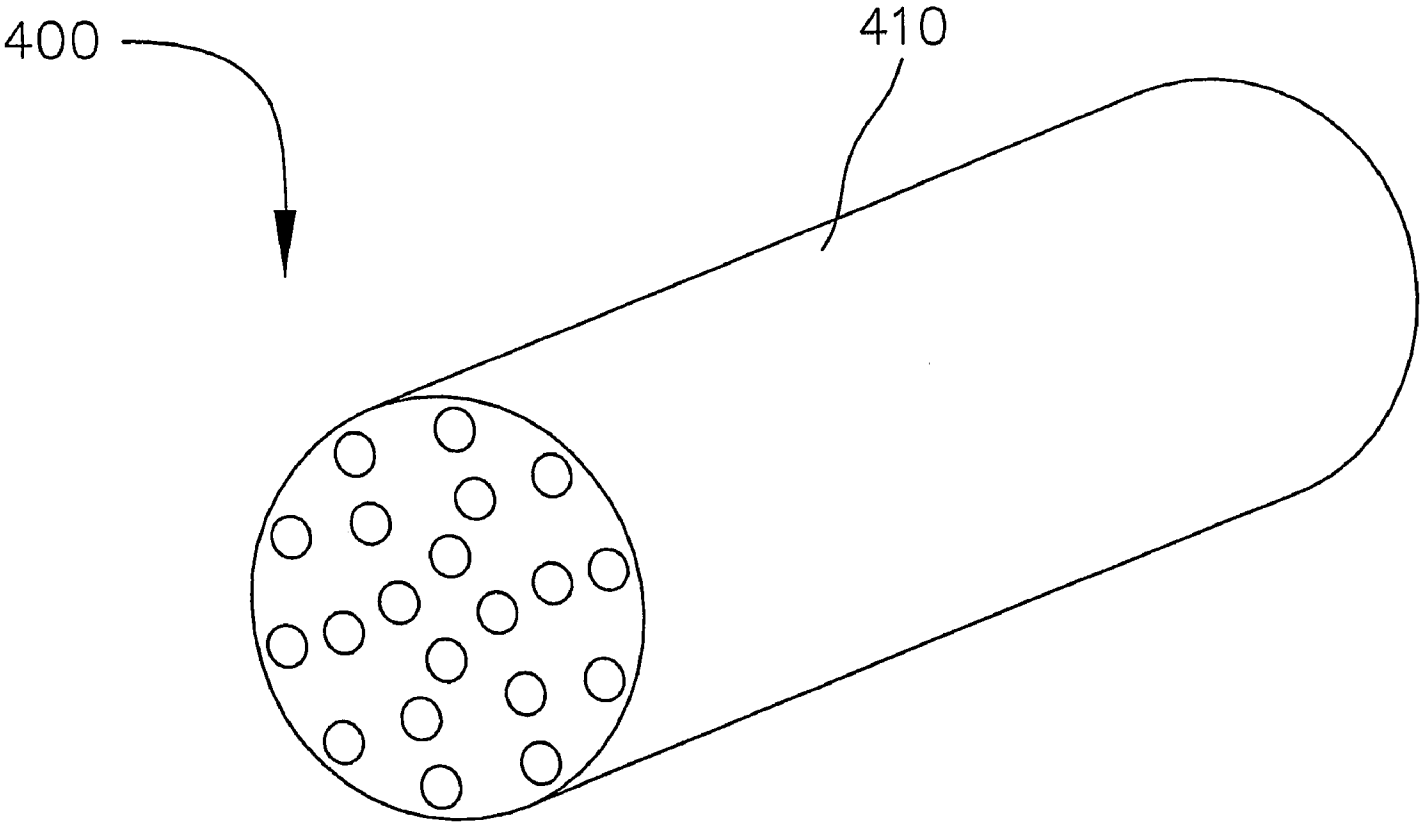
FIG. 4 shows an embodiment of a compressor that comprises a plurality of hydraulically driven compression cylinders disposed within a common cooling jacket.

FIG. 4 is an illustration of a plurality of compressor cylinders 400 that are housed in common cooling jacket 410. Common gas distribution manifolds (not shown) can be incorporated into an end plate that also seals an end of cooling jacket 410, or each cylinder can have its own inlet and outlet gas piping. An advantage of individual piping for each cylinder is that the operation of each cylinder, or groups of cylinders, can be offset from one another to provide a more steady flow of discharge gas.

With cylinders that have smaller bore diameters if it is not be possible to incorporate check valves into an individual end plate for each cylinder, there will be a dead space volume associated with the piping between the end of the cylinder bore and the check valve. However, because the internal diameter of such pipes is small relative to the volume of the compression chamber, the dead space volume is also relatively small (compared to total cylinder volume).

Figure 5:
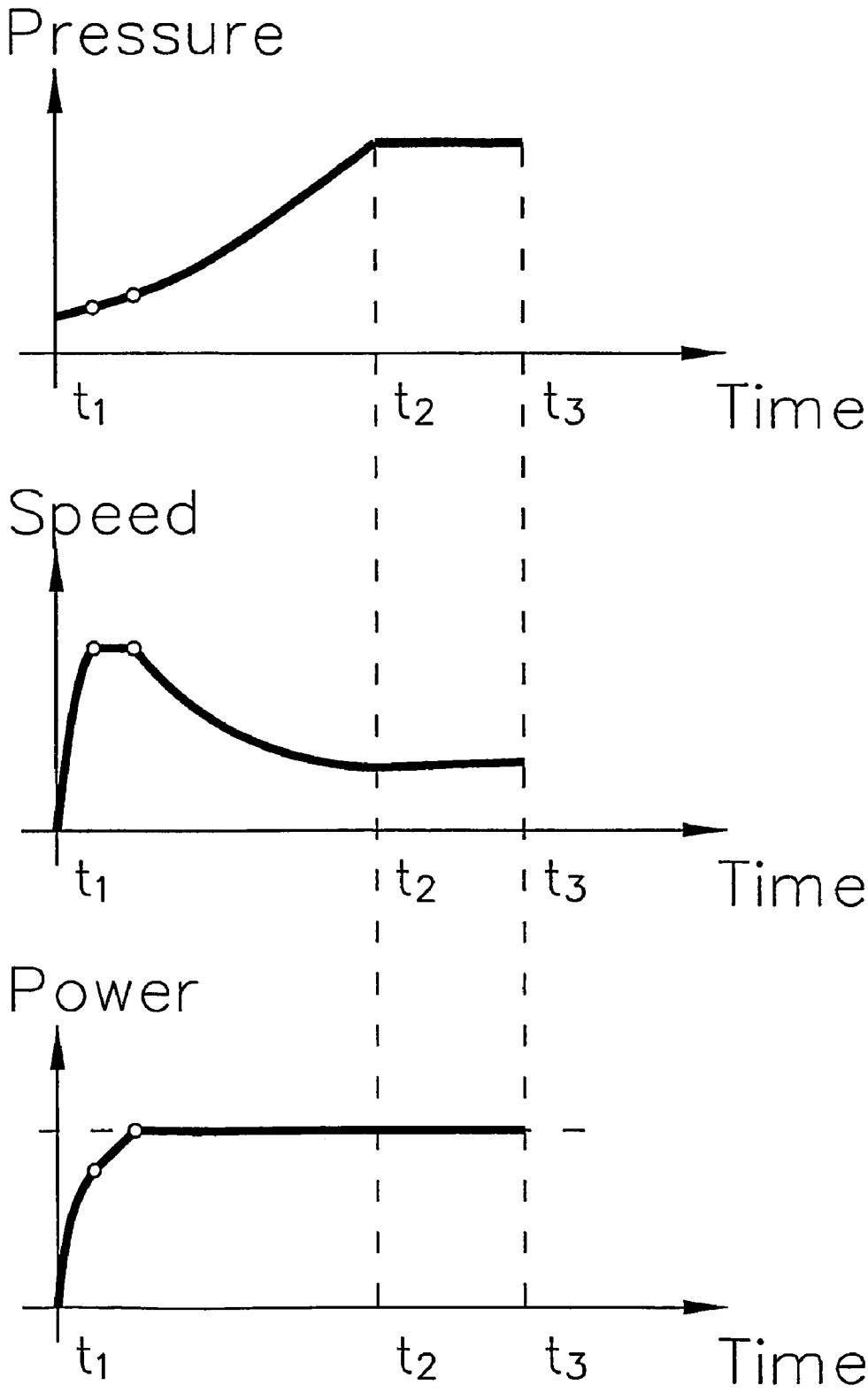
FIG. 5 depicts graphs that show compression chamber pressure, piston velocity, and hydraulic pump power plotted against time which corresponds to piston travel during the course of one compression stroke. The graphs represent an apparatus that employs a hydraulic system with constant power control.

The graphs of FIG. 5 illustrate a methods of controlling compressor operation. In FIG. 5, the power drawn by the hydraulic pump is substantially constant. While there are many ways to design a hydraulic system with substantially constant power requirements, one preferred example is a system that employs a horsepower limited hydraulic pump. For example, when a compressor is employed to supply fuel to an engine, the engine typically provides the power needed to drive the hydraulic pump. That is, whether power to the pump is delivered mechanically (for example, via a drive shaft or belts), or indirectly from electrical power generated by the engine, which drives an electric motor, the power used to operate the hydraulic pump is provided by the engine. When an engine is employed for power generation applications, engine stability and efficiency is improved by operating with less power fluctuations, so it is desirable to limit the maximum power of the hydraulic pump so that it operates with substantially constant power requirements.

FIG. 5 shows the effect of using a horsepower limited hydraulic pump to drive a reciprocating piston compressor. The horizontal axis represents time with t1 being the beginning of the compression stroke and t3 being the end of the compression stroke.

Compression of the gas takes place between t1 and t2. The pressure increases slowly at first and then more rapidly as the compression stroke continues. Conversely, piston velocity is highest near the beginning of the compression stroke, when gas pressure is lowest and there is the least resistance to piston movement. Piston velocity declines as gas pressure increases.

Still with reference to FIG. 5, at t2, the discharge pressure is reached, and from t2 to t3 gas pressure is substantially constant as gas is discharged from the cylinder. Between t2 and t3 piston velocity is also substantially constant, because constant gas pressure results in constant resistance to piston movement.

In the embodiment of FIG. 5, throughout the compression stroke, the power drawn by the hydraulic pump is substantially constant except at the very beginning of the compression stroke where power requirements may be lower because of transient conditions.

A different method of operating the compressor comprises controlling piston velocity to reduce gas discharge temperature to improve heat dissipation and thermodynamics of the compression process, while accepting higher fluctuations in power requirements. In this embodiment, gas compression occurs during two portions of the compression stroke. During the first portion of the compression stroke the objective is to move the piston quickly since there is less temperature gain at low compression ratios. Accordingly, at the beginning of the compression stroke, piston velocity is relatively high. The temperature of the gas is closer to isentropic because at higher piston velocities there is less time for heat to be dissipated, but this is tolerable because the cumulative temperature rise is relatively low. The power drawn by the hydraulic pump is at an intermediate level, because while the hydraulic fluid flow rate is high, the resistance is low since gas pressure is low.

In the second portion of the compression stroke gas pressure is elevated to discharge pressure. In this portion of the compression stroke, the cumulative temperature rise begins to become more significant so piston velocity is reduced to allow more time for heat to dissipate. A balance is selected between reducing piston velocity to achieve almost isothermal compression, and increasing compressor speed to achieve a higher gas flow rate, while maintaining discharge gas temperature significantly less than isentropic. During the second portion of the compression stroke the power drawn by the hydraulic system increases because when piston velocity is substantially constant, resistance increases as gas pressure increases.

During the last part of the compression stroke, the gas pressure equals the discharge pressure and gas is discharged from the cylinder as the piston advances. The pressure during this part of the compression stroke is substantially constant A smooth discharge flow rate is preferred, so piston velocity is preferably constant. Power requirements are also substantially constant at constant pressure and substantially constant piston velocity. The magnitude of the power requirement during the discharge portion of the compression stroke depends upon the predetermined discharge pressure (higher power requirements for higher discharge pressures).

There are many ways, well known in the art for controlling hydraulic fluid flow rate and piston velocity. In one example, a variable displacement pump such as a swash plate pump with an adjustable swash plate angle can be employed.

In this embodiment, the power requirements for the gas compressor are not constant. However, for some applications a variable compressor power requirement is not a problem. For example, when a gas compressor is employed to supply fuel to an engine that is the prime mover for a vehicle, because the load on a vehicle engine already variable, variable compressor power requirements are also manageable. The compressor speed profile during the compression stroke determines the efficiency of a system that is operated according to this method. For example, the speed profile for an individual compressor can be calibrated with regard to gas intake pressure, gas discharge pressure, desired compression ratio, and mass flow requirements.

The timing for switching between the first portion of the compression stroke and the second portion of the compression stroke can be controlled in a number of ways.

In one embodiment, a flow meter measures the flow of hydraulic fluid to the drive cylinders so that the position of the piston is known from the amount of hydraulic fluid that has been supplied. For example, when the flow meter measures an amount of hydraulic fluid that has a volume that is equal to the volume of the drive chamber at the end of the compression stroke, it is known that the piston is at the end of the compression stroke. Such a flow meter can also be used to determine piston position at intermediate points during the compression stroke allowing piston velocity to be controlled based upon piston position.

In other embodiments, other instruments can be employed to determine when piston velocity should be increased or decreased. By way of example, piston velocity can begin a compression stroke at a predetermined velocity, and a pressure sensor and/or temperature sensor can be employed to determine when piston velocity should be decreased to allow more time for heat dissipation.

Those skilled in the art will understand that piston velocity can be controlled to follow many speed profiles.

EXAMPLE 1

Figure 6:
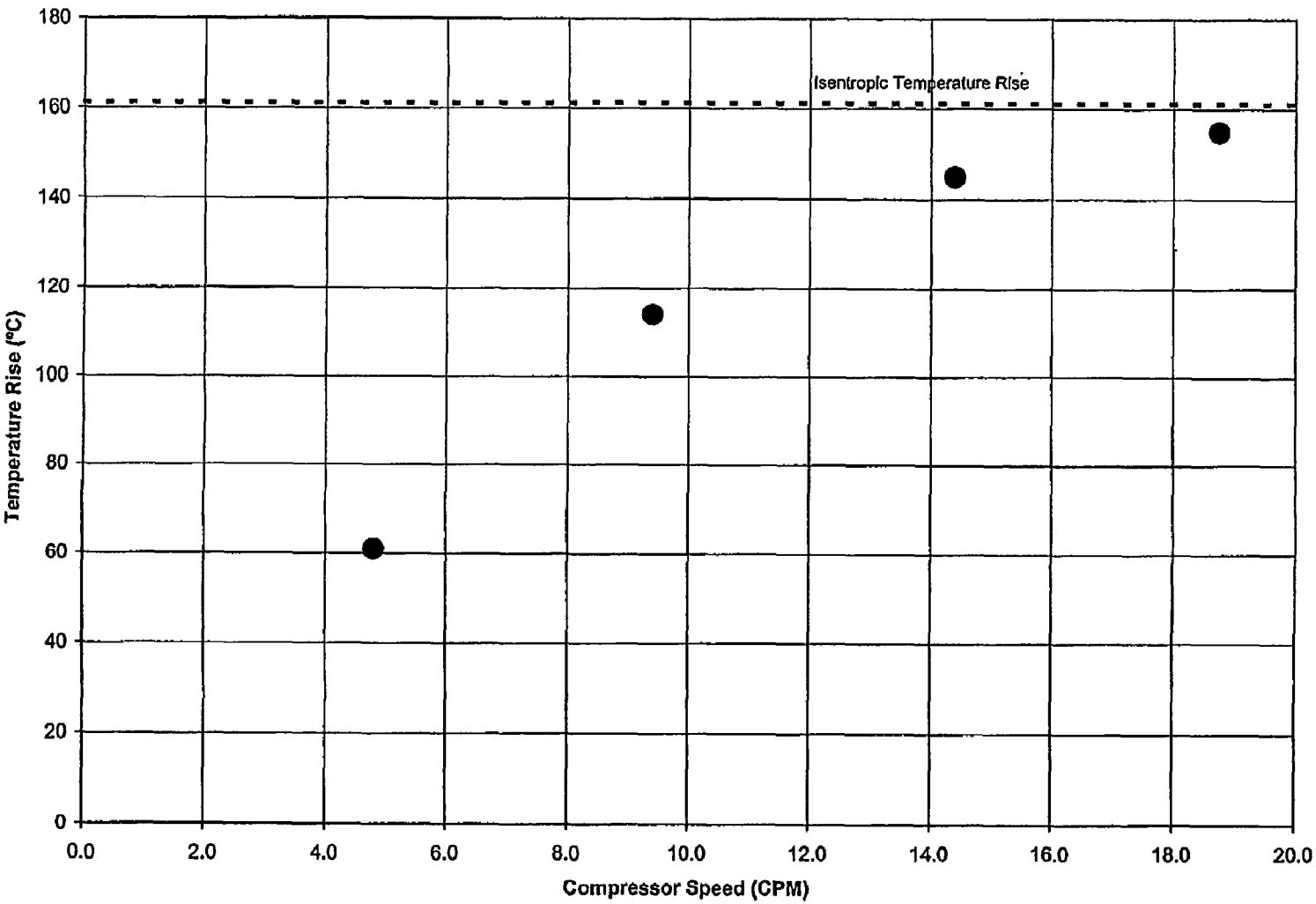
FIG. 6 is a graph of experimental data that plots temperature rise against compressor speed. This graph shows that by using a compressor with a length to diameter ratio of about 7.5:1, gas can be compressed to high pressures with a temperature gain that is significantly less than isentropic if the piston velocity is reduced to a speed that allows time for heat to be dissipated.

The graph shown in FIG. 6 represents data collected from a gas compressor that employed a free floating hydraulically driven piston. The compressor cylinder had a stroke length of 10¼ inches (about 261 mm) and a bore diameter of 1⅜ inches (about 34.9 mm), which corresponds to a length to diameter ratio of about 7.5:1. The cylinder was cooled by ambient air that had a temperature of about 10 degrees Celsius.

The graph of FIG. 6 plots temperature rise in degrees Celsius on the vertical axis against compressor speed in cycles per minute. Nitrogen gas was supplied to the compressor at a temperature of about 0 degrees Celsius.

Table 2 below sets out specific parameters associated with each of the data points.

TABLE 2

| | | | | |
|---|---|---|---|---|
| Compressor Speed (CPM) | 18.8 | 14.4 | 9.4 | 4.8 |
| Inlet Pressure (MPa) | 3.9 | 4.1 | 4.1 | 4.2 |
| Outlet Pressure (MPa) | 20.6 | 20.9 | 20.6 | 20.3 |
| Mass Flow (kg/hr) | 25.8 | 19.6 | 12.6 | 6.7 |

Plotted as a straight line at about 160 degrees Celsius is the temperature rise associated with isentropic conditions. The graph illustrates the following:

a) At compressor speeds lower than 20 cycles per minute, for the same compressor operating with the same compression ratio, the temperature rise measured in the discharged gas begins to decrease as compressor speed decreases.

b) At compressor speeds higher than 20 cycles per minute, there is no significant difference between the actual temperature rise and the temperature rise that would be associated with isentropic conditions. This shows that conventional piston compressors, which operate at speeds much higher than 20 cycles per minute, operate at near isentropic conditions, which limits maximum compression ratios, and requires multiple compression stages, intercoolers, and aftercoolers.

For the gas compressor of this example, a compressor speed of 20 cycles per minute correlates to an average piston velocity of 0.57 feet per second, and as shown by the graph of FIG. 6, piston velocity is preferably still lower. For example, a compressor speed of about 5 cycles per minute correlates to an average piston velocity of 0.14 feet per second. Conventional hydraulically driven piston compressors employ piston velocities that are orders of magnitude higher. At conventional piston velocities the benefits of reduced temperature rise in the compression fluid is not realized, and there is no indication that such benefits can be significant until compressor speed is reduced well below conventional levels.

EXAMPLE 2

The data set out in table 3 below was collected from three experiments done with a larger gas compressor that employed a free floating hydraulically driven piston to compress natural gas. The compressor cylinder had a stroke length of 54 inches (about 1370 mm) and a bore diameter of 2½ inches (about 64 mm), which corresponds to a length to diameter ratio of about 21.6:1.

A coolant consisting of 50% glycol and 50% water was circulated through a cooling jacket surrounding the compressor cylinder. The temperature of the coolant supplied to the water jacket was about 15 degrees Celsius.

The hydraulic system employed a constant power hydraulic pump, resulting in piston velocity automatically decreasing as resistance to piston movement increased with increasing gas pressure.

The three experiments were done with different cycle frequencies (measured in cycles per minute) and different compression ratios.

TABLE 3

| | Experiment | | |
|---|---|---|---|
| | #1 | #2 | #3 |
| Cycle Frequency | 3 | 5 | 12 |
| Average Piston Velocity | 0.45 ft/s (0.14 m/s) | 0.75 ft/s (0.23 m/s) | 1.6 ft/s (0.49 m/s) |
| Compression Ratio | 5.07 | 5.18 | 5.78 |
| Gas Pressure (Inlet) | 680 psig | 690 psig | 644 psig |
| Gas Pressure (Outlet) | 3504 psig | 3636 psig | 3794 psig |
| Gas Temperature (Inlet) | 13.6° C. | 13.6° C. | 8.6° C. |
| Gas Temperature (Outlet) | 112.5° C. | 126.3° C. | 137.9° C. |
| Gas Temperature Rise (actual) | 98.9° C. | 112.8° C. | 129.3° C. |
| Temperature Rise (Isentropic) | 151.7° C. | 153.9° C. | 157.9° C. |
| Difference between Actual Temperature Rise and Isentropic Temperature Rise | 39.2° C. | 27.6° C. | 20.0° C. |

Even though the compression ratios are slightly different, the data in table 3 from experiments #1 and #2 illustrates that lower cycle frequencies and a lower average piston velocity can be employed to significantly reduce the temperature rise during the compression stroke. In these experiments, a significant reduction in the temperature rise was achieved with an average piston velocity less than 0.75 feet per second (about 0.23 meters per second). In experiment #3 some heat was dissipated but gas discharge temperature was only 20 degrees Celsius less than isentropic. Persons skilled in the art will understand that additional steps could be taken to reduce the discharge temperature further. By way of example, reducing the temperature of the coolant supplied to the water jacket or increasing the flow rate of the coolant are steps that can be taken to further reduce gas discharge temperature.

While reducing gas temperature rise has been disclosed as being advantageous for thermodynamic and energy efficiency, it is also important to note that reducing temperature rise also results in a cooler apparatus, which is in itself beneficial. For example, the apparatus comprises moving parts that require dynamic seals. The effective life of dynamic seals is typically prolonged by maintaining them at cooler temperatures during operation.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of compressing a gas in a hydraulically driven reciprocating piston compressor that comprises a cylinder; a free floating piston disposed within said cylinder between a first closed end and a second closed end; a compression chamber defined by a volume within said cylinder between said first closed end and said piston; and a drive chamber defined by a volume within said cylinder between said second closed end and said piston; said method comprising:

(a) in an intake stroke, supplying said gas to said compression chamber;

removing said hydraulic fluid from said drive chamber, whereby said gas supplied to said compression chamber is at a higher pressure than said hydraulic fluid within said drive chamber, causing said piston to move to reduce the volume of said drive chamber and increase the volume of said compression chamber until said compression chamber has expanded to a desired volume and is filled with said gas; and (b) in a compression stroke, supplying said hydraulic fluid to said drive chamber whereby said hydraulic fluid within said drive chamber is at a higher pressure than said gas within said compression chamber, causing said piston to move to increase the volume of said drive chamber and reduce the volume of said compression chamber thereby increasing the pressure of said gas held within said compression chamber;

discharging said gas from said compression chamber when the pressure of said gas is increased in a single cycle to a pressure of at least 2500 psi (17.2 MPa), which is at least five times greater than the pressure of the gas supplied to said compression chamber;

employing a piston stroke length to piston diameter ratio of more than even to one; and dissipating heat from said cylinder during said compression stroke whereby said gas is discharged from said compression chamber with a temperature significantly less than isentropic.

2. The method of claim 1 further comprising employing a cylinder with a piston stroke length to piston diameter ratio of between ten to one and one hundred to one.

3. The method of claim 1 further maintaining an average piston velocity that is less than or equal to 1.5 feet per second (0.46 meters per second).

4. The method of claim 1 further comprising transferring heat from said cylinder to said ambient environment through a heat dissipator.

5. The method of claim 4 wherein said heat dissipator comprises a cooling jacket disposed around said cylinder and directing a coolant to flow through said cooling jacket.

6. The method of claim 5 wherein coolant flows through said cooling jacket with a velocity that ensures there are no stagnant pockets within said cooling jacket.

7. The method of claim 5 further comprising supplying said gas to an engine and supplying said coolant from an engine coolant reservoir, but from a circuit that is independent from engine cooling circuits.

8. The method of claim 5 wherein said heat dissipator comprises a plurality of fins protruding from said cylinder and said heat dissipator operates by conducting heat from said cylinder to said plurality of fins which provides a greater surface area for transferring heat to the ambient environment.

9. The method of claim 8 further comprising blowing air through said plurality of fins to increase heat dissipation.

10. The method of claim 1 further comprising controlling when said piston reverses direction by sensing when said piston is proximate to an end of said cylinder.

11. The method of claim 1 further comprising controlling piston velocity during said compression stroke whereby said piston travels with at a first velocity during a first portion of the compression stroke and with a second velocity during a second portion of the compression stroke, wherein said second portion follows sequentially after said first portion and said second velocity is lower than said first velocity.

12. The method of claim 11 further comprising changing from said first portion of said compression stroke to said second portion of said compression stroke when gas pressure within said compression chamber exceeds a predetermined set point.

13. The method of claim 11 further comprising controlling piston velocity during a discharge portion of said compression stroke that occurs after said second portion of said compression stroke when gas is being discharged from said compression chamber, wherein piston velocity during said discharge portion is kept substantially constant.

14. The method of claim 13 wherein said piston velocity during said discharge portion of said compression stoke is equal to or less than piston velocity during said second portion of said compression stroke.

15. The method of claim 1 further comprising controlling piston velocity to follow a predetermined speed profile.

16. The method of claim 15 further comprising selecting said predetermined speed profile in response to a measured operating parameter.

17. The method of claim 16 wherein said in measured operating parameters include at least one of desired mass flow rate, inlet gas pressure, desired gas discharge pressure, and desired compression ratio.

18. The method of claim 15 further comprising selecting said predetermined speed profile from a plurality of predetermined speed profiles to control piston velocity at different times during a compression stroke, wherein said speed profiles control piston velocity to be highest near the beginning of the said compression stroke with piston velocity gradually declining to a lower velocity before stopping at the end of the compression stroke, the difference between said plurality of predetermined speed profiles can be the piston velocity at different times and/or the rate that piston velocity changes during the compression stroke, wherein of said plurality of predetermined speed profiles, said selected predetermined speed profile maximizes thermodynamic efficiency of compression for the desired mass flow rate and compression ratio.

19. The method of claim 1 further comprising gradually reducing piston velocity during a compression stroke, until said gas is being discharged from said compression chamber, and then maintaining a substantially constant piston velocity for the remainder of said compression stroke.

20. The method of claim 1 further comprising supplying a substantially constant amount of power to a hydraulic pump during a compression stroke, whereby piston velocity decreases as gas pressure within said compression chamber increases.

* * * * *

UNITED STATES PATENT AND TRADEMARK OFFICE

CERTIFICATE OF CORRECTION

PATENT NO. : 7,527,482 B2
APPLICATION NO. : 10/508617
DATED : May 5, 2009
INVENTOR(S) : Mihai Ursan, Anker Gram and Gabriel Gavril It is certified that error appears in the above-identified patent and that said Letters Patent is hereby corrected as shown below:

Column 18, line 65 (claim 1): after “of more than”, change “even” to --seven--.

Signed and Sealed this
Third Day of May, 2011

David J. Kappos

David J. Kappos
*Director of the United States Patent and Trademark Office*